United States Patent [19]

Kovaleski

[11] 3,997,127

[45] Dec. 14, 1976

[54] WIRE PAY-OFF CAP ASSEMBLY

[76] Inventor: Joseph J. Kovaleski, c/o Wyrepak Ind., Inc., 136 James St., Bridgeport, Conn. 06604

[22] Filed: Oct. 14, 1975

[21] Appl. No.: 622,025

[52] U.S. Cl. ..... 242/128; 242/129.8

[51] Int. Cl.[2] ..... B65H 49/00

[58] Field of Search ..... 242/128, 129.72, 129.8, 242/82; 57/34 R, 58.38, 58.49, 58.83, 58.86, 59, 60, 62

[56] References Cited

UNITED STATES PATENTS

| | | | |
|---|---|---|---|
| 3,202,380 | 8/1965 | Hosbein | 242/128 |
| 3,425,647 | 2/1969 | Kovaleski et al. | 242/128 |
| 3,462,098 | 8/1969 | Sommo | 242/129.8 |
| 3,791,119 | 2/1974 | Godderidge | 57/34 R |

*Primary Examiner*—Leonard D. Christian
*Attorney, Agent, or Firm*—H. Gibner Lehmann; K. Gibner Lehmann

[57] ABSTRACT

A quick-connect pay-off cap assembly facilitating the dereeling of wire from a spool. The assembly includes a support member which carries a freely rotatable, flanged take-off wheel and a stationary circular tension brush having multiple tines extending past the wheel periphery and adapted to be brushed by the wire as it passes the flange of the wheel. The support member includes a radially expansible friction locking part which is insertable into either the bore of the spool or a hollow part of the support spindle which carries the spool. Manually operable means are provided on the support member for actuating the friction locking part. The arrangement is such that it enables an especially quick installation of the cap assembly to a particular spool or its spindle, all without the need for special tools or equipment.

12 Claims, 10 Drawing Figures

WIRE PAY-OFF CAP ASSEMBLY

CROSS REFERENCES TO RELATED APPLICATIONS AND PATENTS

U.S. Pat. No. 3,425,647, issued Feb. 4, 1969 to Joseph J. Kovaleski, and entitled "Wire Take-Off Device."

Applicant's co-pending application, U.S. Ser. No. 563,792, filed Mar. 31, 1975, and entitled "Spool Handling Dolly."

Applicant's co-pending application, U.S. Ser. No. 578,364, filed May 16, 1975, and entitled "Tension Brush with Adjustable Brake."

Applicant's co-pending application, U.S. Ser. No. 620,319 filed Oct. 7, 1975, and entitled SUPPORTING FIXTURES FOR WIRE CARRYING SPOOLS.

Applicant's co-pending application, U.S. Ser. No. 563,787, filed Mar. 31, 1975, and entitled "Tension Brush for Wire Spool and Method for Making Same."

BACKGROUND

This invention relates generally to wire spooling equipment, and more particularly to devices for facilitating the de-reeling of wire from a spool.

Applicant's U.S. Pat. No. 3,425,647, issued Feb. 4, 1969 shows a pay-out cap assembly comprising a freely rotatable wheel and stationary tension brush for de-reeling wire off the free end of a spool. In the past, it has been customary to shift the spools by rolling them on their circular flanges to the desired location, and raising the ends of the spools off the ground to enable installation thereon of take-off cap assemblies. The latter have usually been secured by means of special hubs received in the spool bores. Although such prior constructions have been found to be generally satisfactory, their installation and use was relatively time-consuming, and the devices thus did not lend themselves to high speed operation.

SUMMARY

The above drawbacks and disadvantages of prior cap assemblies for wire spools are obviated by the present invention, which has for an object the provision of a novel and improved quick-connect cap assembly which is simple in construction, reliable in operation and which features especially quick installation on and removal from an existing spool. A related object is the provision of a cap assembly as above, wherein no special tools are required for installation and few separate parts are involved, whereby the fabrication cost is kept low.

The above objects are accomplished by a wire pay-off cap assembly for use with wire-filled spools to control the unreeling of wire past the ends thereof, comprising a support member, a flanged wheel rotatably carried on said support member, and a circular tension brush disposed broadside to the wheel and having a plurality of radially disposed tines extending past the wheel periphery, wherein the member includes a radially movable friction-locking part adapted to be received in a cavity at the end of the spool, for retaining the assembly in a predetermined position with respect thereto. In one embodiment, the friction-locking part directly engages the bore of the spool, and in another embodiment, the part engages the walls of a recess in the end of the support spindle which carries the spool. Manually operable means are provided for actuating the friction-locking part and moving it between an expanded, locked position and a contracted, releasing position. The arrangement is such that it enables an especially quick installation of the cap assembly to a particular spool or its spindle, all without the need for special tools or equipment. Removal of the cap assembly is also readily accomplished.

Features of the invention reside in the provision of a cap assembly which is sturdy and rugged in construction, and which employs few moving parts, being economical to construct and assemble.

Other features and advantage will hereinafter appear.

In the drawings, illustrating several embodiments of the invention:

FIG. 3 is a side elevational view of a spindle part employed in the cap assembly of FIGS. 1 and 2.

Figures 1, 2, 4, 5:
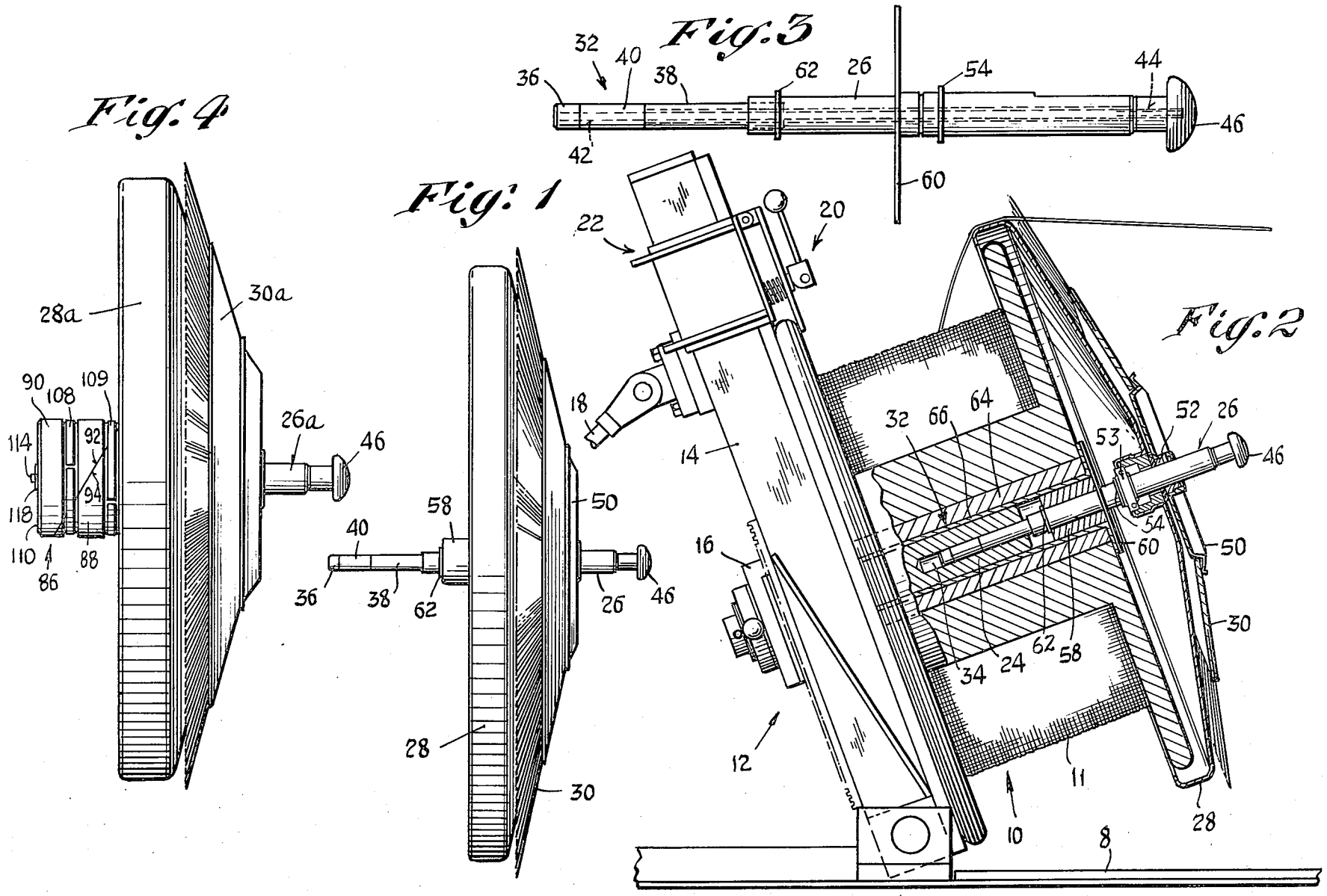
FIG. 1 is a side elevational view of an improved quick-connect, wire pay-off cap assembly constructed in accordance with the present invention, and showing a friction-locking part comprising a tubular compression sleeve disposed between a pair of axially movable compression members.
FIG. 2 is a sectional view of the pay-off cap assembly of FIG. 1, installed at the end of a spool carried on a tilting and support fixture, and illustrating further details of the construction.
FIG. 4 is a side elevational view of a modified quick-connect cap assembly, adapted to directly engage the bore of a spool, this construction constituting another embodiment of the invention.
FIG. 5 is a sectional view of the pay-off cap assembly of FIG. 4, installed in the end of a spool which is carried on a tilting and support fixture, and illustrating further details of the construction.
Figure 5:
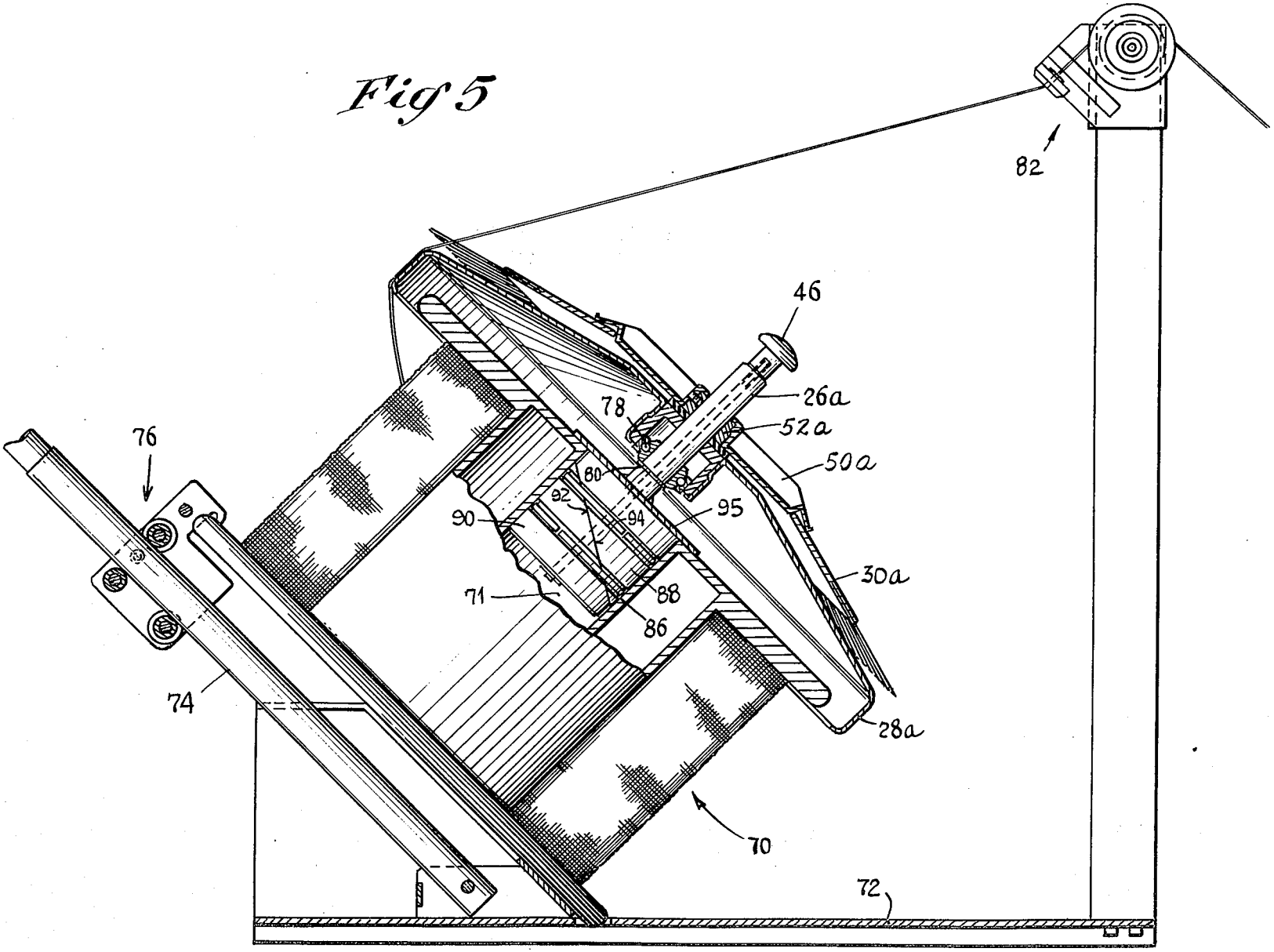

Referring first to FIG. 2, there is illustrated a wire-carrying spool 10 having multiple turns of wire 11 carried on a tilting and support fixture 12 which is substantially identical to one illustrated and described in my co-pending application, U.S. Ser. No. 620,319, filed Oct. 7, 1975, and entitled SUPPORTING FIXTURES FOR WIRE-CARRYING SPOOLS. The fixture includes a base 8, an upright pivotally mounted support 14, and a spindle support block 16 which is vertically movable to predetermined positions along the upright support, for accommodating spools of different diameters. Tilting of the support and spools is accomplished by a hydraulic device or other powered means (not shown) connected to a link or arm 18. The flange of the spool which is adjacent to the upright support 14 is secured by a clamp 20 which is mounted on a carriage 22, also adjustably slidable along the upright 14. The spindle support block 16 carries a spindle 24 which is capable of being partially withdrawn from the block during positioning of a filled spool on the base. Following such positioning, the spindle can be inserted into the spool bore and the upright support 14 tilted to the position of FIG. 2, so as to raise one end of the spool and enable pay-out of wire to occur.

Referring to FIGS. 1–3 and in accordance with the present invention there is provided a novel quick-connect wire pay-off cap assembly for controlling the unreeling of wire past the free end of the spool, the assembly comprising a support member including a spindle or shaft 26, a freely rotatable wheel 28 carried by the spindle and having a flange extending past the periphery of one flange of the spool, a stationary brush 30 having radially disposed tines extending past the flange of the wheel, and a friction-locking part 32 disposed at one end of the spindle 26 and adapted to engage the walls of a recess or cavity 34 in the end of the spool support spindle 24. The friction-locking part is particularly illustrated in FIG. 3 and includes a pair of tubular, axially-disposed compression members 36, 38, and a radially expansible, axially compressible, resilient tubular sleeve 40. The member 36 is carried on a rod 42 which passes through the sleeve 40 and member 38, extending through the spindle 26, and protruding from its other end. The protruding part 44 of the rod 42 is threaded and carries a headed nut 46. The compression member 38 is rigid with the spindle 26, and it can be seen that as the nut 46 is tightened, the rod 42 will urge the member 36 toward the right in FIG. 3, effecting axial compression and radial expansion of the sleeve 40. The latter will, in turn, frictionally engage the walls of the recess 34 of the spool support spindle 24, thus retaining the spindle 26, brush 30 and wheel 28 in position at the end of the spool.

Referring for the moment to FIGS. 2 and 3, the tension brush 30 has a hub 50 secured to the spindle 26 by a sleeve 52 and carrying a set screw. The wheel 28 is mounted on a ball bearing 53, which is axially held in position on the spindle 26 by a flange 54. A centralizing bushing 58 is also carried on the spindle 26 and disposed between a stop flange 60 and a retainer washer 62. Interposed between the spool support spindle 24 and the bore of the spool are two spacer bushings 64, 66, the latter one being flanged and engaging the stop flange 60 when the cap assembly is installed.

In operation, with the upright support 14 disposed in a vertical position, the spacer bushings 64, 66 can be inserted into the bore of the spool after it has been rolled into position. The spool support spindle 24 is then inserted into the bushing 66, and the support 14 (and spool 10) tilted to the position of FIG. 2. This enables installation of the cap assembly comprising the brush 30, wheel 28 and spindle 26 at the right hand end of the spool in FIG. 2, as shown. Following insertion of the friction-locking part into the cavity 34, the nut 46 is tightened, causing expansion of the sleeve 40 and tight frictional engagement of the latter with the cavity walls. Pay-out of wire off the raised end of the spool can now commence.

In some of the appended claims, the term spool is used to denote not only the side flanges and the connecting hub but also any bushings contained in the hub and functioning as intermediaries or mountings.

Another embodiment of the invention is shown in FIGS. 4, 5, 8 and 9, illustrating a modified quick-connect cap assembly for a wire carrying spool 70. The latter includes a bore 71, and is shown as being supported on a manually operated tilting fixture comprising a base 72 and upright arm 74. The arm 74 slidably carries a jaw 76 adapted to engage one flange of the spool as shown. The improved quick-connect cap assembly of the invention includes a freely rotatable wheel **28*a* and stationary circular tension brush 30*a*, carried on a support member which includes a spindle 26*a*. As in the previous embodiment, the wheel 28*a* is carried on a ball bearing 78 which is held in position by a retainer washer 80. The brush 30*a* includes a hub 50*a* carried on a sleeve 52*a*. Mounted on the base 72 is a wire guide 82 which receives the strand from the spool and which, together with the brush 30*a***, maintains a tension in the strand to prevent excessive looseness and kinking.

Figure 8:
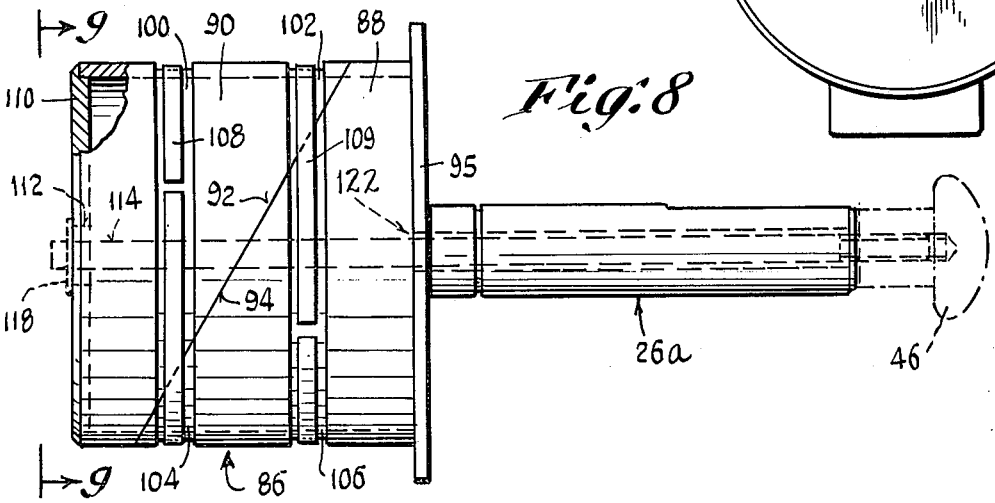
FIG. 8 is a side elevational view of another type of support member, such as is shown in FIG. 5 and mounted in a spool.

Referring to FIGS. 4, 5, 8 and 9, and in accordance with the present invention the spindle **26*a* includes a radially expansible friction-locking part 86 which is receivable in the bore 71 of the spool 70 and adapted to frictionally engage the same. The spindle 26*a* and locking part 86 are illustrated in FIG. 8 in their operative positions, without the wheel or brush, in order to clearly illustrate the operation. The locking part comprises wedging members 88, 90 having cooperable slide surfaces 92, 94 respectively in engagement with one another. The member 88 has a stop flange 95 welded to it for limiting its insertion into the bore of the spool (such as in the application of an assembly of this type shown in FIG. 5), and the flange 95 is in turn welded to the spindle 26*a*. A pair of parallel circumferential grooves 100, 102 are provided in the member 90, these being in alignment with circumferential grooves 104, 106 in the member 88. Grooves 100, 104 receive a split retainer spring 108 of generally annular configuration, and a second spring 109 of similar construction is received in the aligned grooves 102, 106. These tend to maintain contact between the wedging members 88, 90** while they being inserted into or withdrawn from the bore of the spool.

Referring again to FIGS. 8 and 9, the member 90 carries an end plate 110 which has a central aperture 112 to receive one end of a threaded rod 114. The latter extends through the members 88, 90, through the hollow spindle **26*a*, and protrudes from the end thereof. The rod 114 carries a nut 46 by which axial shifting of the rod can be effected. A retainer washer 118 is carried by the other end of the rod and engages the end plate 110 of the member 90**.

It can be seen that with the nut 46 loosened, the members 88, 90 are normally held together by the retainer springs 108, 109. The diameter of each member is seen to be slightly less than that of the bore of the spool with which the cap assembly is to be employed. In operation, the cap assembly is installed at the end of the spool by insertion of the members 88, 90 into the spool bore until the stop flange engages the spool flange. Tightening of the nut 46 draws the rod 114 toward the right in FIG. 8, causing the member 90 to slide on the member 88, along the plane of their abutting surfaces 92, 94. Such sliding gives rise to a relative lateral shifting between the members, such that each is urged in diametrically opposite directions into forcible engagement with the bore of the spool, thus frictionally holding the cap assembly captive thereon. It will be understood that the split springs 108, 109 yield somewhat to enable this lateral shifting of the members to occur. Following pay-out of the desired amount of wire, the nut 46 can be loosened, releasing the members 88, 90, and enabling their withdrawl from the spool bore.

Figure 6:
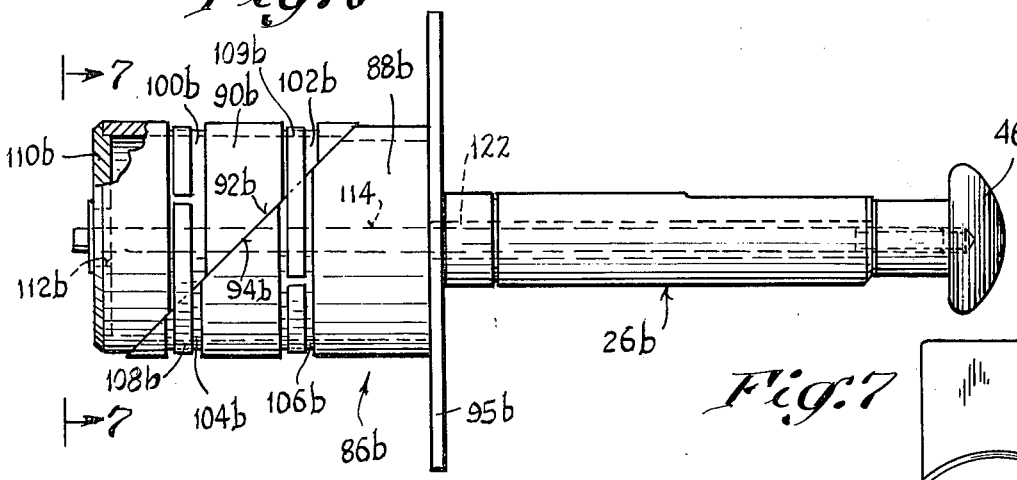
FIG. 6 is a side elevational view of one type of support member adaptable for engagement with spool bores.
Figure 7:
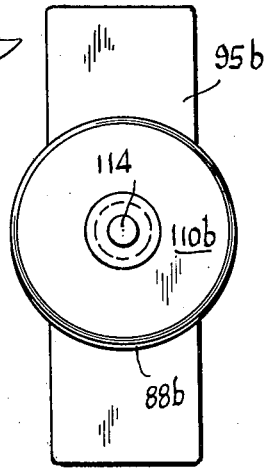
FIG. 7 is a view taken on line 7—7 of FIG. 6.
Figure 9:
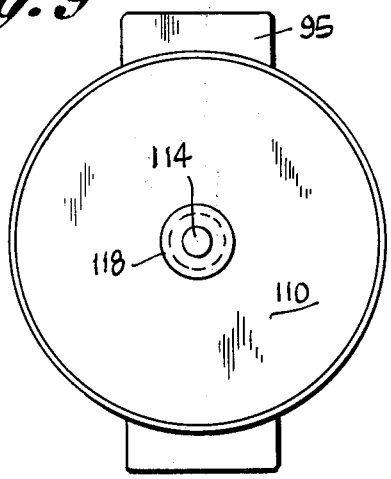
FIG. 9 is a view taken on line 9—9 of FIG. 8.

Another embodiment of the invention is shown in FIGS. 6 and 7, illustrating a support member 86*b* having a spindle 26*b*, stop flange 95*b*, and wedging members 88*b*, 90*b*. The support member carries an end plate 110*b* which has an aperture 112*b* to receive the rod 114. Circumferential grooves 100*b*, 102*b* in the member 90*b*, and grooves 104*b* in the member 88*b* receive springs 108, 109 as in the previous embodiment. The members 88*b*, 90*b* have cooperable facing slide surfaces 92*b*, 94*b* which are inclined at a smaller angle with respect to the axis of the spindle 26*b* than the angle illustrated in FIGS. 8 and 9. The latter angle is on the order of 60°, whereas the angle in FIG. 6 is on the order of 45°. The advantage of the increased angle shown in FIGS. 8 and 9 is that greater lateral shifting between the members 88, 90 occurs for a given axial displacement of the rod 114. This construction is especially adapted for use with spools having large bores. The operation of the embodiment of FIGS. 6 and 7 is substantially the same as that of the embodiment of FIGS. 8 and 9, and accordingly need not be repeated.

The embodiments of FIGS. 6–9 are especially useful in enabling the pay-off cap assemblies incorporating them to be adapted to a wide variety of spool sizes and spool bores, with quick installation and removal being made possible. With the cap assembly of FIGS. 8 and 9 installed on a spool as illustrated in FIG. 5, the wedging members 88, 90 are shown as slightly offset or misaligned in consequence of the nut 46 having been tightened. FIG. 6 shows the spindle 26*b* and wedging members 88*b*, 90*b* in their operative gripping positions, and without the wheel or brush, in order to illustrate the operation. The lateral offset of the members under this condition is also clearly shown in this figure. It will be understood that the cap assembly is inserted with the nut 46 loosened, whereby the spring rings 108*b* and 109*b* maintain the wedging members 90*b*, 88*b* in true alignment to facilitate their easy insertion into the bore 71.

The installation of FIG. 5 relates to spools having relatively large bores. Where the spools have smaller bores, the assemblage of FIGS. 6 and 7 is utilized, having wedging members 88*b*, 90*b* of smaller diameter and steeper slide surfaces 92*b*, 94*b*. In each case, the attachment and removal of the pay-off cap is quickly accomplished with the utmost convenience, and large variations in spool bores can be readily accommodated.

Figure 10:
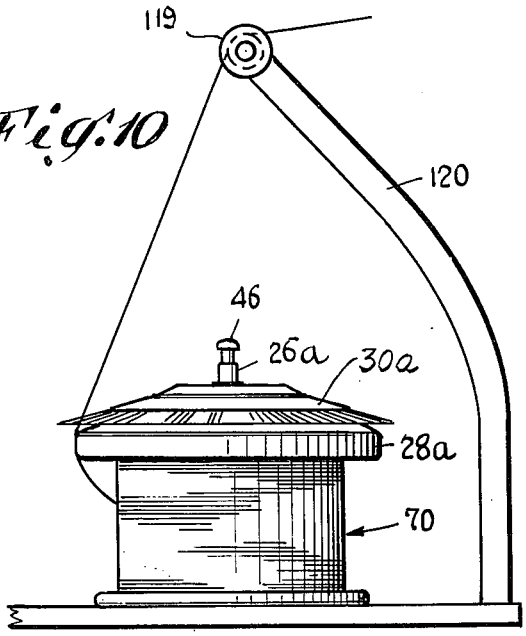
FIG. 10 is a view like 5, except showing the spool resting on one of its flanges, and employing the pay-off cap assembly of FIGS. 4, 5, 8 and 9 carried above the other flange, for effecting vertical pay-out of wire from the spool.

The tilting fixture comprising the base 72, support 74 and clamp 76 shown in FIG. 5 indicates just one possible arrangement for raising one flange of a wire-carrying spool in order to enable installation of a cap assembly thereto. Other arrangements would work equally as well. FIG. 10 shows a typical installation wherein the spool 70 is resting directly on one of its end flanges, and wherein a quick-connect cap assembly identical to that described in connection with FIGS. 4, 5, 8 and 9 is employed. Under such circumstances, pay-out will occur vertically, with the strand passing over an idler pulley 119 carried by a suitable upright support 120 mounted on the supporting surface carrying the spool 70, or on the floor. Otherwise, the details of the construction of FIG. 10 are similar in all respects to that of FIGS. 4, 5, 8 and 9 and accordingly need not be discussed further.

The main advantage of the construction shown in FIGS. 4–9 is that substantial deviations in the mean diameter of a spool bore can be tolerated. After prolonged use, there is a tendency for the diameter of the spool bore to increase, either through wear or warping. I have found that due to the substantial lateral shift capability of the wedging members, such changes in the bore dimensions have negligible effect on the ability of the present quick-connect cap assembly to grip the bore. Slightly larger bores are accommodated merely by tightening the nut 46 a bit more to effect the necessary engagement of the walls by the members 88, 90 or 88*b*, 90*b*. Accordingly, many of the problems associated with prior spooling devices are obviated.

In accomplishing the substantial capability of the cap assemblies of the invention to be accommodated in a large variety of spools, there is provided a substantial clearance space indicated at 122 in FIGS. 6 and 8, between the rod 114 and the bore of the spindles or tubes 26*a* or 26*b*, particularly at points adjacent the wedging members 88 and 88*b*. Such large clearance space enables the movable wedging members 90 or 90*b* to have a maximum amount of lateral or gripping movement with respect to the wedging members 88 or 88*b*. This is an important feature of the invention, since it enables the force exerted by turning of the nut 46 (hereinafter also referred to as a handpiece device) to be utilized to the greatest possible extent in the gripping action of the wedging members. A fulcrumming effect is had between the nuts 46 on the one hand, and the contacting end surface of the spindles 26*a* and 26*b*, such fulcrumming being made possible by the substantial clearance 122 provided around the rod 114. Of course, the large hollows or spaces within the wedging members 88, 90 and 88*b*, 90*b* also contribute to this end.

From the foregoing it can be seen that I have provided novel and improved quick-connect cap assemblies for wire carrying spools, the devices being especially simple in construction and reliable in operation. Installation or disassembly can be effected with a minimum of time and effort, with no special tools being required. Accordingly, the device is seen to be especially well suited for use with high speed wire transfer equipment, and represents a distinct advance and improvement in this field.

Variations and modifications are possible without departing from the spirit of the invention.

I claim:

1. A wire pay-off cap assembly for use with wire-filled spools to control the unreeling of wire past the ends thereof, comprising in combination:

a. a wheel having a rim adapted for engagement with the wire being unreeled, b. a circular brush disposed broadside to the wheel, having tines extending past the wheel periphery, c. a support member rotatably mounting said wheel and fixedly mounting said brush in their respective operative positions, d. said member having a radially movable friction-locking part shiftable between gripping and releasing positions and receivable in a cavity at the end of a wire-filled spool to frictionally lock said assembly to the cavity walls with the wheel broadside to the spool end, and e. manually operable means carried by the support member, for actuating said radially movable part between said gripping and releasing positions whereby the assembly can be quickly secured at and removed from said spool.

2. The invention as set forth in claim 1, wherein:

a. said support member includes a hub receivable in the bore of the spool, b. a shaft extending through said hub, c. a pair of compression members carried by said shaft, one being adapted to be moved axially toward the other in response to actuation of said manually operable means, d. said friction locking part including a tubular compression sleeve carried by said shaft and disposed between the compression members, axial compression of the sleeve causing its radial expansion into firm engagement with the walls of the cavity, thereby holding the cap assembly captive.

3. The invention as defined in claim 1, wherein:

a. said radially movable locking part comprises one of a pair of wedging members carried by the support member and adapted to be inserted into and to engage the bore of the spool, said wedging members respectively having a pair of cooperable slide surfaces in engagement with one another to provide for relative sliding movement in a direction inclined to the spool axis.

4. The invention as defined in claim 3, and further including:

a. retainer means carried by said wedging members for normally holding the latter in contact while still enabling said sliding movement to occur.

5. The invention as defined in claim 4, wherein:

a. said wedging members are constituted as mating sections of a cylinder, b. said members respectively having circumferentially extending grooves in alignment with one another, c. said retainer means comprising a split annular retainer spring receivable in said aligned grooves.

6. The invention as defined in claim 3, and further including:

a. a stop flange carried by one of said wedging members for limiting the insertion thereof into the bore of the spool.

7. The invention as defined in claim 3, wherein:

a. said manually operable means includes a threaded rod engaged by one of said wedging members, for effecting relative sliding movement thereof in a given direction, and includes a nut carried by the threaded portion of the rod.

8. The invention as set forth in claim 1, wherein:

a. said friction-locking part includes an expansion member engagable with the bore of the spool.

9. The invention as set forth in claim 1, and further including:

a. a spindle for carrying the spool, said spindle having a hollow bore defining said cavity, b. said friction-locking part being receivable in said spindle bore to lock the cap assembly thereto.

10. The invention as defined in claim 3, wherein:

a. said manually operable means includes a rod attached to said one wedging member to effect the relative sliding movement thereof, and includes a handpiece device comprising means connected with the rod, for shifting the latter axially, b. said support member having portions surrounding the rod and spaced from the latter a substantial distance to permit the rod to have appreciable lateral movement at points adjacent said other wedging member.

11. The invention as defined in claim 10, wherein:

a. said support member comprises a tube one end of which is attached to said other wedging member.

12. The invention as defined in claim 10, and further including:

a. fulcrum means between said support member and said handpiece device, enabling the latter and said rod to fulcrum about an end portion of the support member.

* * * * *